US010737828B2

(12) United States Patent
Ertl

(10) Patent No.: US 10,737,828 B2
(45) Date of Patent: Aug. 11, 2020

(54) DISPLAY HEADER SYSTEM

(71) Applicant: WestRock Container, LLC, Atlanta, GA (US)

(72) Inventor: Joe Ertl, Richfield, MN (US)

(73) Assignee: WestRock Container, LLC, Atlanta, GA (US)

( * ) Notice: Subject to any disclaimer, the term of this patent is extended or adjusted under 35 U.S.C. 154(b) by 0 days.

(21) Appl. No.: 16/127,309

(22) Filed: Sep. 11, 2018

(65) Prior Publication Data

US 2019/0185200 A1 Jun. 20, 2019

Related U.S. Application Data

(60) Provisional application No. 62/608,068, filed on Dec. 20, 2017.

(51) Int. Cl.

| | |
|---|---|
| ***B65D 5/52*** | (2006.01) |
| ***G09F 23/00*** | (2006.01) |
| *A47F 5/11* | (2006.01) |
| *B65D 5/42* | (2006.01) |

(52) U.S. Cl.

CPC ..... *B65D 5/5213* (2013.01); *B65D 5/5246* (2013.01); *G09F 23/00* (2013.01); *A47F 5/114* (2013.01); *B65D 5/4237* (2013.01)

(58) Field of Classification Search

CPC .. B65D 5/5246; B65D 5/5226; B65D 5/5233; B65D 5/4237; B65D 5/4241; A47F 5/144

USPC ..... 229/103, 108; 206/767, 768, 45.29, 45.3

See application file for complete search history.

(56) References Cited

U.S. PATENT DOCUMENTS

| | | | | |
|---|---|---|---|---|
| 5,351,882 | A * | 10/1994 | Krautsack | B65D 5/4208 206/45.26 |
| 5,979,338 | A | 11/1999 | Salmanson | |
| 6,126,131 | A | 10/2000 | Tietz | |
| 6,244,194 | B1 | 6/2001 | Salmanson | |
| 6,386,371 | B1 * | 5/2002 | Parsons | B65D 5/504 206/485 |
| 6,454,107 | B1 * | 9/2002 | Belanger | B65D 5/724 206/556 |
| 6,581,330 | B1 | 6/2003 | Helsloot | |
| 6,607,199 | B2 | 8/2003 | Gruber | |
| 6,609,466 | B2 | 8/2003 | Salmanson | |
| 6,722,292 | B2 | 4/2004 | Salmanson | |
| 6,857,642 | B2 | 2/2005 | Gruber | |
| 6,892,876 | B1 | 5/2005 | Aubry | |
| 6,925,943 | B2 | 8/2005 | Salmanson | |
| 7,004,379 | B2 * | 2/2006 | Holdsworth | B65D 5/0035 229/164 |
| 7,104,553 | B2 | 9/2006 | Gruber | |
| 7,159,521 | B2 | 1/2007 | Salmanson | |

(Continued)

FOREIGN PATENT DOCUMENTS

| | | | | |
|---|---|---|---|---|
| GB | 2234959 A * | 2/1991 | | B65D 5/2047 |
| GB | 2234959 A1 | 2/1991 | | |

OTHER PUBLICATIONS

U.S. Office Action dated May 6, 2019 corresponding to U.S. Appl. No. 15/442,238, filed Feb. 24, 2017 (9 pages).

*Primary Examiner* — Nathan J Newhouse
*Assistant Examiner* — Phillip D Schmidt
(74) *Attorney, Agent, or Firm* — WestRock IP Legal

(57) ABSTRACT

A product display includes a display header and a tray. The display header is coupled to the tray for showing product indicia related to products stored in the tray to a customer at a retail location.

3 Claims, 9 Drawing Sheets

(56) References Cited

U.S. PATENT DOCUMENTS

| | | | | |
|---|---|---|---|---|
| 7,407,086 | B2 | 8/2008 | Borio | |
| 7,681,783 | B2 | 3/2010 | Stephenson | |
| 7,766,348 | B2 | 8/2010 | McFarland | |
| 7,845,894 | B2 | 12/2010 | Dickinson | |
| 8,485,370 | B2 | 7/2013 | Dewhurst | |
| 8,561,816 | B2 | 10/2013 | Martin | |
| 8,584,860 | B2 | 11/2013 | Orischak | |
| 8,720,089 | B1 | 5/2014 | Lewis | |
| 8,733,563 | B2 | 5/2014 | Fadrowski | |
| 8,833,573 | B2 | 9/2014 | Tomaszewski | |
| 8,857,633 | B2 | 10/2014 | Dewhurst | |
| 8,863,417 | B2 | 10/2014 | Gerstner | |
| 8,978,280 | B2 | 3/2015 | Holt | |
| 8,991,624 | B2 | 3/2015 | Brozak | |
| 9,186,453 | B1 * | 11/2015 | Russell | A61M 5/1414 |
| 9,415,893 | B2 | 8/2016 | Wintermute | |
| 10,016,074 | B1 * | 7/2018 | Finnegan | B65D 5/66 |
| 2004/0144837 | A1 * | 7/2004 | Dye | B65D 5/2047 229/164 |
| 2006/0124710 | A1 * | 6/2006 | Sun | B65D 5/2038 229/112 |
| 2014/0097122 | A1 * | 4/2014 | Patterson | B65D 5/5226 206/758 |
| 2016/0176570 | A1 | 6/2016 | Collier | |
| 2017/0238727 | A1 | 8/2017 | Ertl | |
| 2017/0267399 | A1 | 9/2017 | Buscema | |
| 2017/0297772 | A1 | 10/2017 | Davis | |

* cited by examiner

DISPLAY HEADER SYSTEM

PRIORITY CLAIM

This application claims priority under 35 U.S.C. § 119(e) to U.S. Provisional Application Ser. No. 62/608,068, filed Dec. 20, 2017, which is expressly incorporated by reference herein.

BACKGROUND

The present disclosure relates to a product display, and particularly to a product display having a display header and a tray. More particularly, the present disclosure relates to a product display having a display header attached to a tray for showing product indicia related to products stored in the tray to a customer at a retail location.

SUMMARY

A product display in accordance with the present disclosure includes a display header system and a tray. The display header system is coupled to the tray for showing product indicia related to products stored in the tray to a customer at a retail location.

In illustrative embodiments, the display header system includes a header board and a header mount. The header mount is coupled to the tray to support the header board on the tray. The header board includes a front side and a back side opposite the front side. The product indicia is positioned on the front side of the header board. The header board is movable from a shipping position to a display position relative to the tray. The product indicia is obscured by the tray when the header board is in the shipping position and visible when the header board is in the display position.

In illustrative embodiments, the header mount includes a brace and a board mover. The board mover is coupled to the tray and a lower end of the header board to support the header board relative to the tray for movement between the shipping and display positions. The brace guides movement of the header board relative to the tray.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
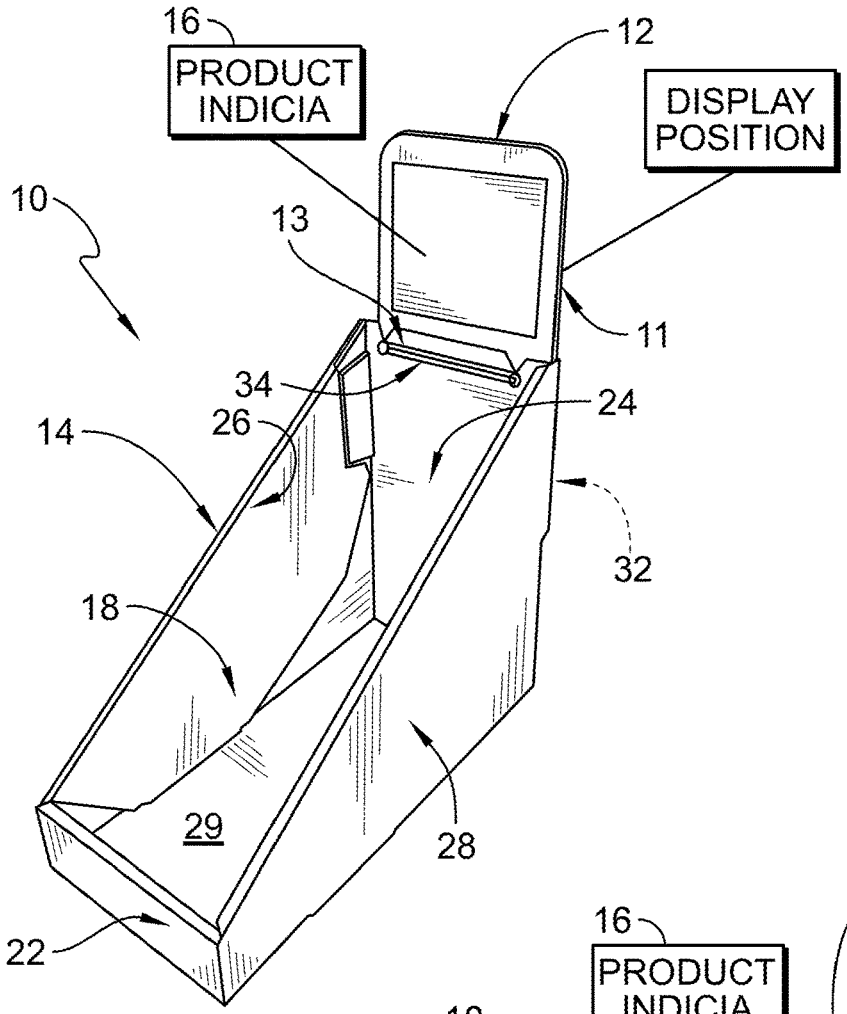
FIG. 1 is a front perspective view of a product display in accordance with the present disclosure showing that the product display includes a display header coupled to a tray for showing product indicia related to products stored in the tray to a customer at a retail location when the display header is in a display position.

A product display 10 in accordance with the present disclosure is shown in FIG. 1. Product display 10 includes a display header system 12 (also called a display header 12) coupled to a product support structure, such as a tray 14. Tray 14 is configured to support product in a product-storage region 18 for display in a retail setting. Product indicia 16 related to products stored in tray 14 is positioned on a front side of display header 12 and visible when display header 12 is in a display position as shown in FIG. 1. Product display 10 is sized to fit on a shelf or counter-top, for example, at the retail location. In some embodiments, an internal volume of tray 14 is less than two (2) cubic feet. In some embodiments, an internal volume of tray 14 is less than one (1) cubic feet.

Figure 2:
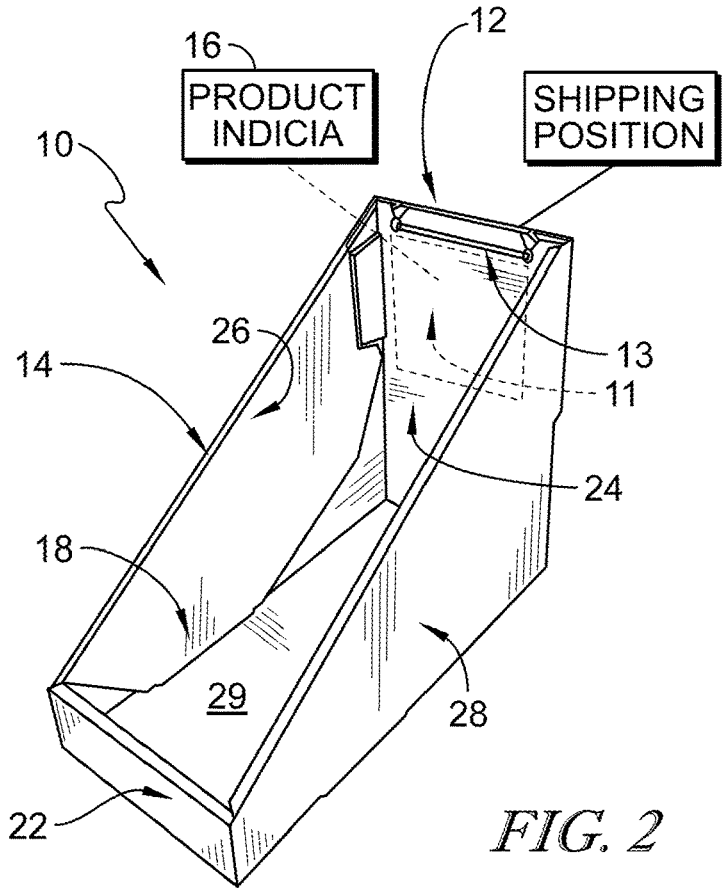
FIG. 2 is a similar view to FIG. 1 showing that the display header includes a header board and a header mount configured to hold the header board on the tray for movement between the display position and a shipping position and suggesting that the header board slides relative to the tray to obscure at least a portion of the product indicia when the header board is moved to the shipping position.

Display header 12 includes a header board 11 and a header mount 13 coupled to tray 14 to support header board 11 for movement relative to tray 14 between the display position, as shown in FIG. 1, and a shipping position, as shown in FIG. 2, at the selection of a user. At least a portion of product indicia 16 is obscured from view when header board 11 is in the shipping position and a height of product display 10 is reduced compared to when header board 11 is in the display position. In the illustrative embodiment, header mount 13 biases header board 11 toward the display position to support header board 11 in the display position for showing product indicia 16 to customers at a retail location as suggested in FIG. 1.

Figure 3:
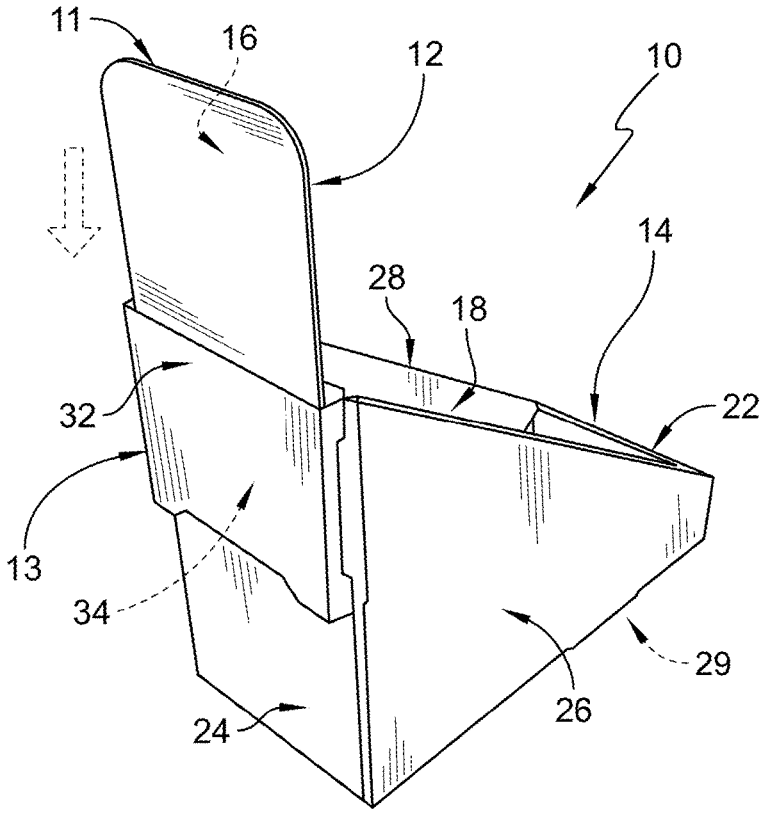
FIG. 3 is a rear perspective view of the product display of FIG. 1 showing that the header mount includes a brace and a board mover and suggesting that the brace traps the header board between the brace and the tray and that the board mover engages with an upper portion of the tray, as shown in FIG. 1, and a lower portion of the header board to bias the header board toward the display position.
Figure 4:
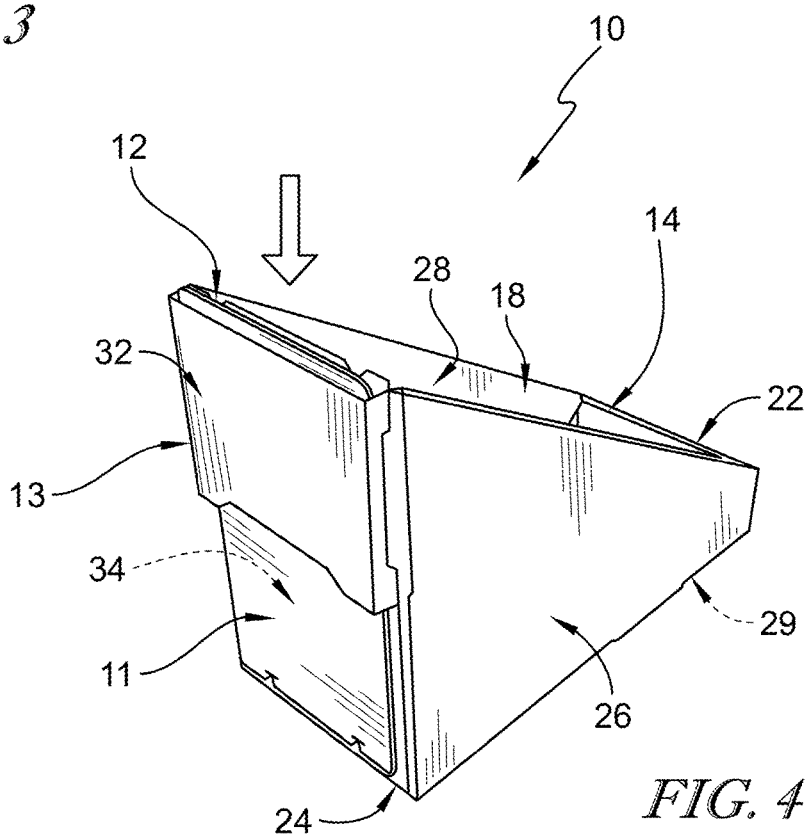
FIG. 4 is a similar view to FIG. 3 showing the header board moved to the shipping position and suggesting that the brace guides the header board during movement between the display and shipping positions.

Tray 14 includes a front wall 22, back wall 24, left and right side walls 26, 28, and a floor 29 that define product-storage region 18 as shown in FIG. 1. Header mount 13 includes a brace 32 and a board mover 34 as shown in FIGS. 3 and 4. Brace 32 is coupled to back wall 24 and configured to guide header board 11 during movement between the display and shipping positions. Board mover 34 is coupled between an upper portion of back wall 24 (as shown in FIG. 1) and a lower portion of header board 11 (as shown in FIG. 4) to bias header board 11 toward the display position. In some embodiments, board mover 34 is an elastic member having barbs attached to opposing ends thereof to secure the elastic member to header board 11.

Figure 5:
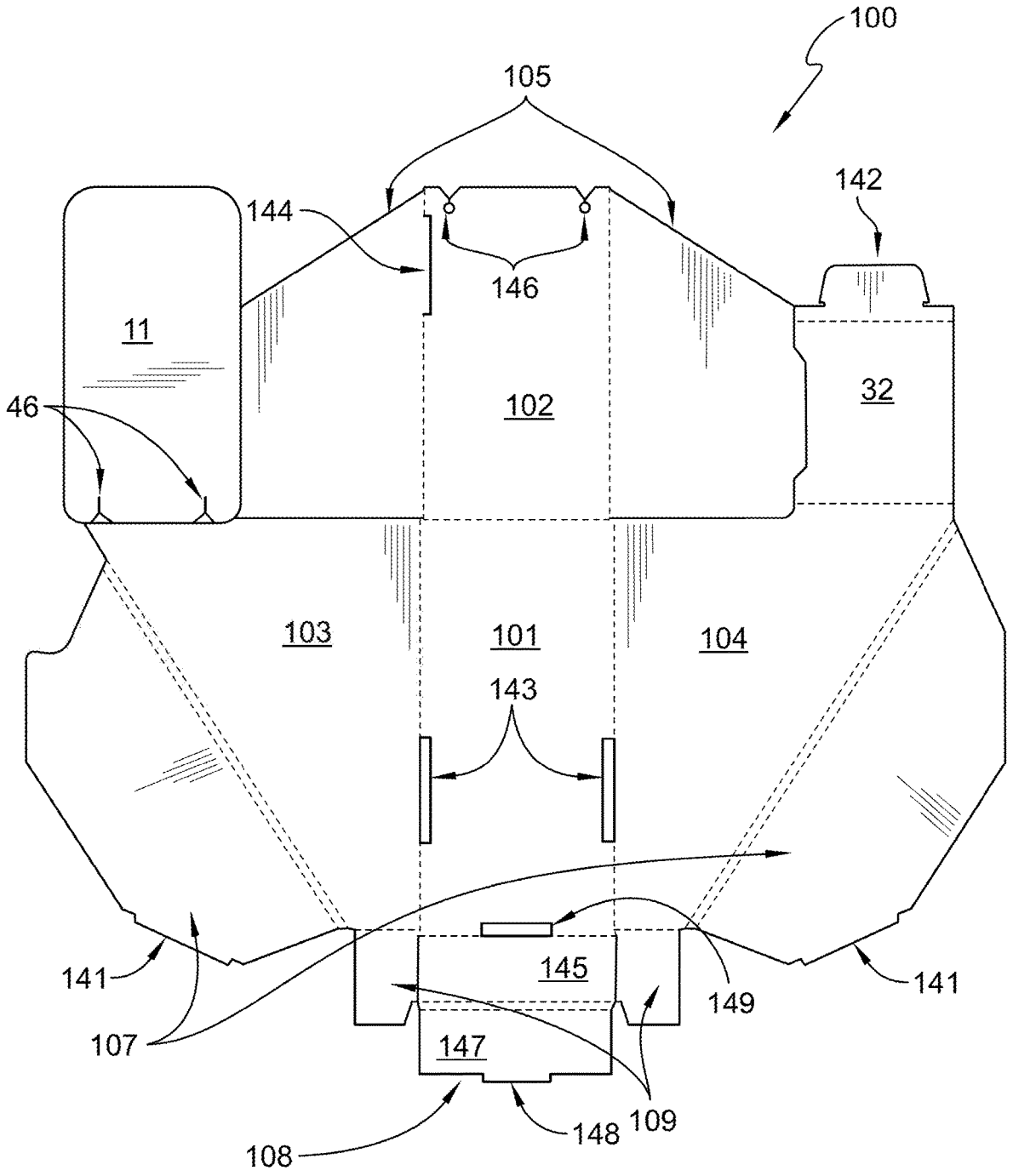
FIG. 5 is a top plan view of one embodiment of a blank in accordance with the present disclosure used to form the tray and header board of the product display of FIG. 1.

One embodiment of a blank 100 in accordance with the present disclosure used to form tray 14 and header board 11 is shown in FIG. 5. As shown and described herein, when making reference to a blank of material, solid lines denote a cut line where adjacent portions of material are severed from one another and dashed lines denote a fold line where portions of material are folded relative to one another. In some examples, fold lines are scored or perforated. It is within the scope of the present disclosure to make blanks from a variety of materials including corrugated paperboard, folding carton, solid fiber, plastic sheeting, plastic corrugated, combinations thereof, or any other suitable material.

Blank 100 includes a series of panels 101, 102, 103, 104 coupled to one another, and a series of flaps 105, 107, 108, 109 coupled to panels 101, 102, 103, 104 as shown in FIG. 5. A back panel 102 is coupled to a base panel 101 and foldable relative to base panel 101. Flaps 105 are coupled to opposing sides of back panel 102 and foldable relative to back panel 102 toward one another. Side panels 103, 104 are coupled to opposing sides of base panel 101 and foldable relative to base panel 101 toward one another. A flap 107 is coupled along an opposing edge of each of side panels 103, 104 opposite from base panel 101. A tab 141 extending from each flap 107 engages with a slot 143 formed in base panel 101 during formation of tray 14.

A lock flap 108 is coupled to an opposing end of base panel 101 from back panel 102 and foldable relative to base panel 101 toward back panel 102 as shown in FIG. 5. Lock flap 108 includes a proximal strip 145 coupled to base panel 101 and a distal strip 147 coupled to an opposing end of strip 145 from base panel 101. Strip 145 is foldable relative to base panel 101, and strip 147 is foldable relative to strip 145. A tab 148 extending from strip 147 engages with a slot 149 formed in base panel 101 during formation of tray 14. Flaps 109 are coupled to side panels 103, 104 and are foldable relative to panels 103, 104.

In the illustrative embodiment, header board 11 is formed as part of blank 100. In some embodiments, header board 11 is coupled to one or more of panel 103 and flap 105 by a perforation for removal by an assembler of product display 10. In some embodiments, header board 11 is formed separately from blank 100. Brace 32 is coupled to panel 104 and a lock tab 142 extending from brace 32 is configured to engage with a slot 144 formed in panel 102 to hold brace 32 in position relative to panel 102 when tray 14 is formed. In some embodiments, brace 32 is formed separately from blank 100 and attached to tray 14 using adhesives or interlocking tabs and slots, for example. Panel 102 is formed to include notches 146 configured to receive board mover 34 to hold board mover 34 on tray 14.

Flaps 108, 109 together form front wall 22 of tray 14 when assembled as suggested in FIG. 5. Back panel 102 defines back wall 24 of tray 14 when assembled. In some embodiments, brace 32 and back panel 102 together define back wall 24 of tray 14 when assembled. Side panel 103 with attached flap 107 and one of flaps 105 together define side wall 26. Side panel 104 with attached flap 107 and the other of flaps 105 together define side wall 28. Base panel 101 defines floor 29 of tray 14 when assembled.

Figure 6:
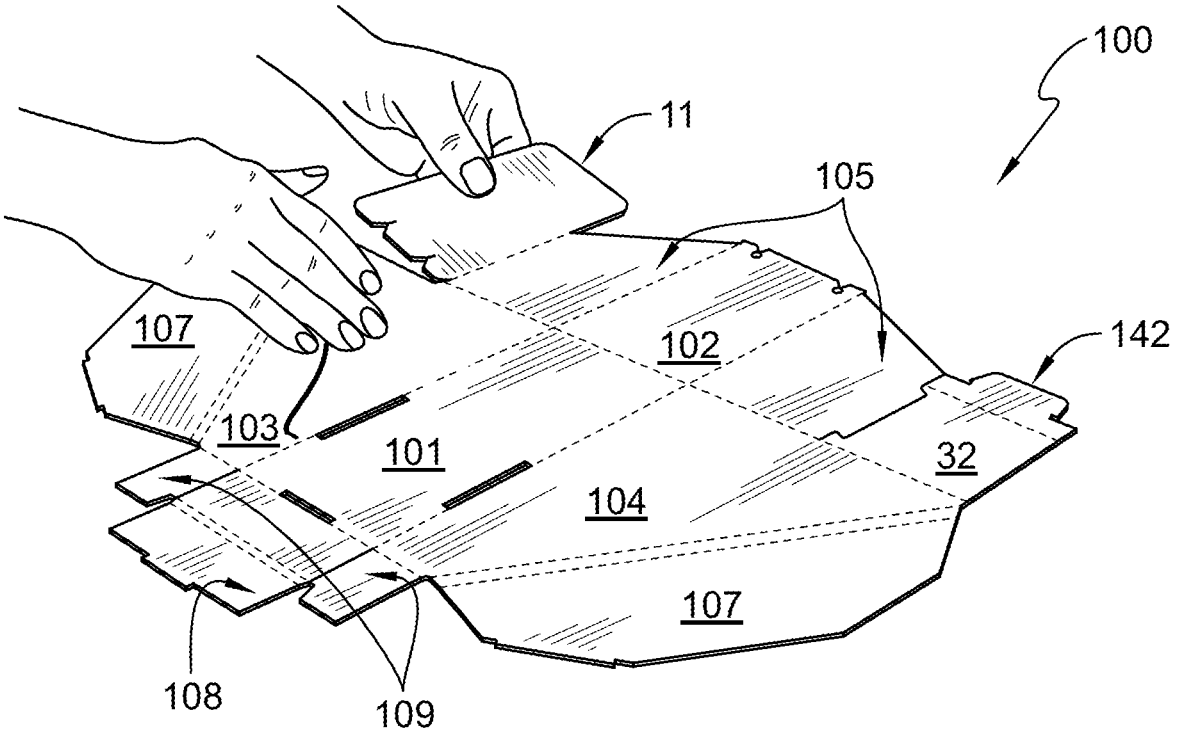
FIGS. 6-10 are a series of views showing a process in accordance with the present disclosure for forming the tray from the blank of FIG. 5.
Figure 7:
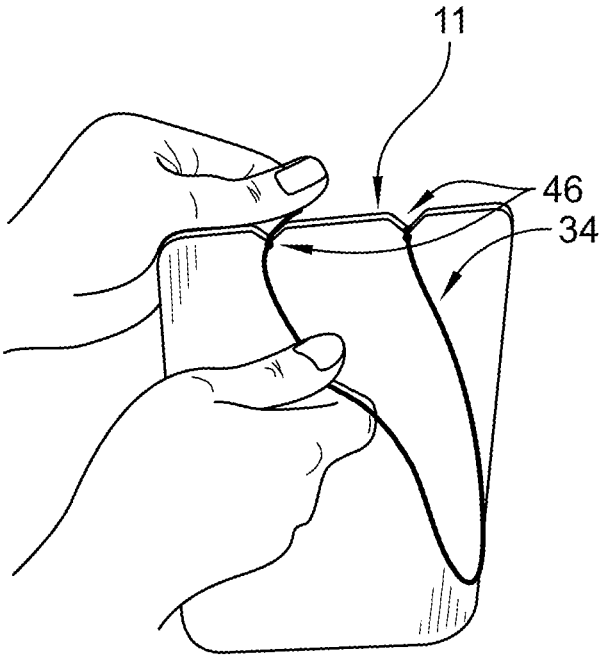
Figure 8:
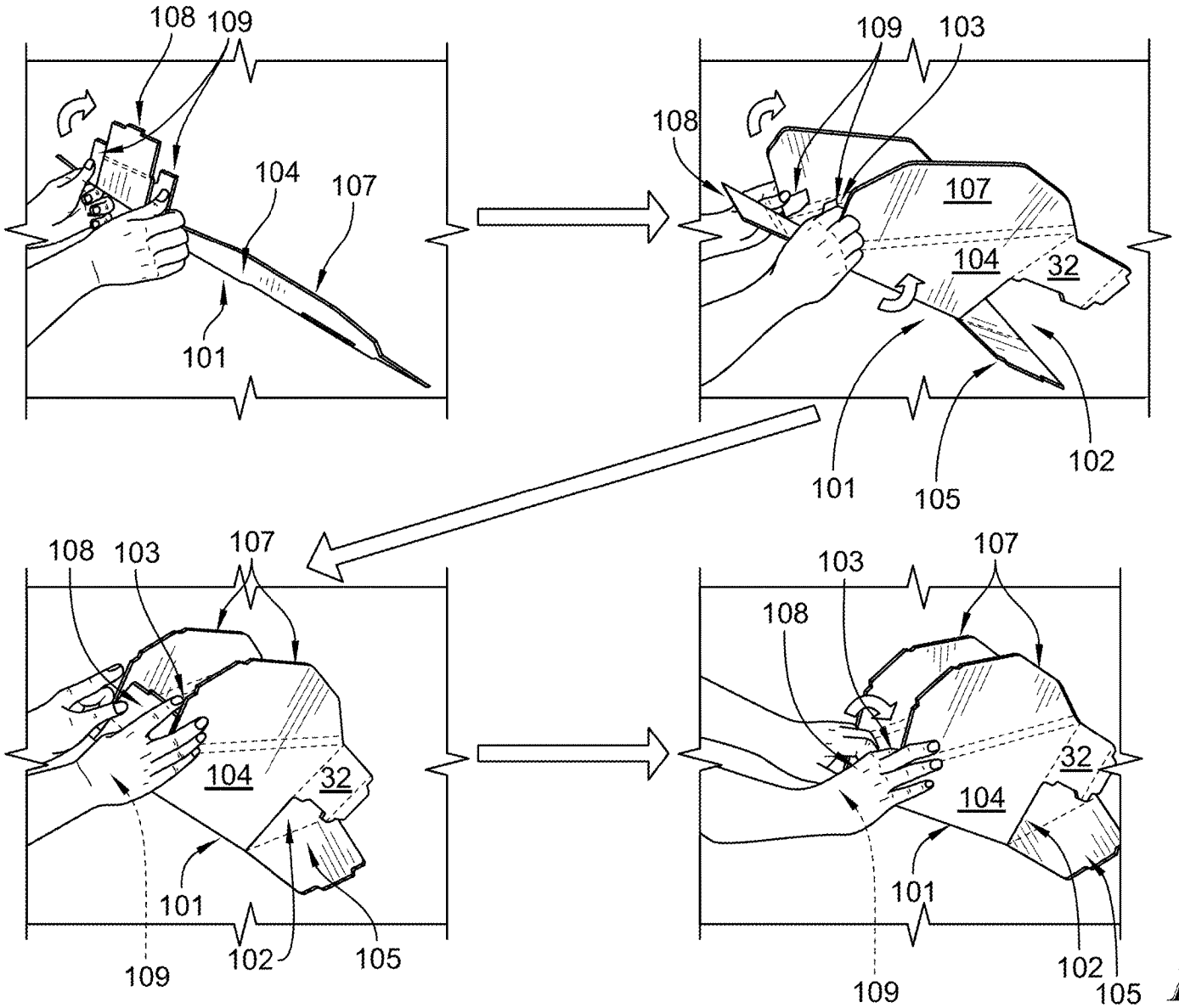

One illustrative process for forming tray 14 from blank 100 is shown in FIGS. 6-10. Header board 11 is removed from blank 100, as shown in FIG. 6, and board mover 34 is secured in notches 46, as shown in FIG. 7. Flaps 109 are folded relative to panels 103, 104 and panels 103, 104 are folded toward one another relative to panel 101 such that flaps 109 extend toward one another as shown in FIG. 8. Proximal strip 145 of flap 108 is folded relative to panel 101 and distal strip 147 is folded over flaps 109 to trap flaps 109 and hold panels 103, 104 in place. Flaps 108, 109 form front wall 22 and panel 101 forms floor 29 of tray 14. Tab 148 of flap 108 engages with slot 149 of panel 101 to hold flap 108 in place.

Figure 9:
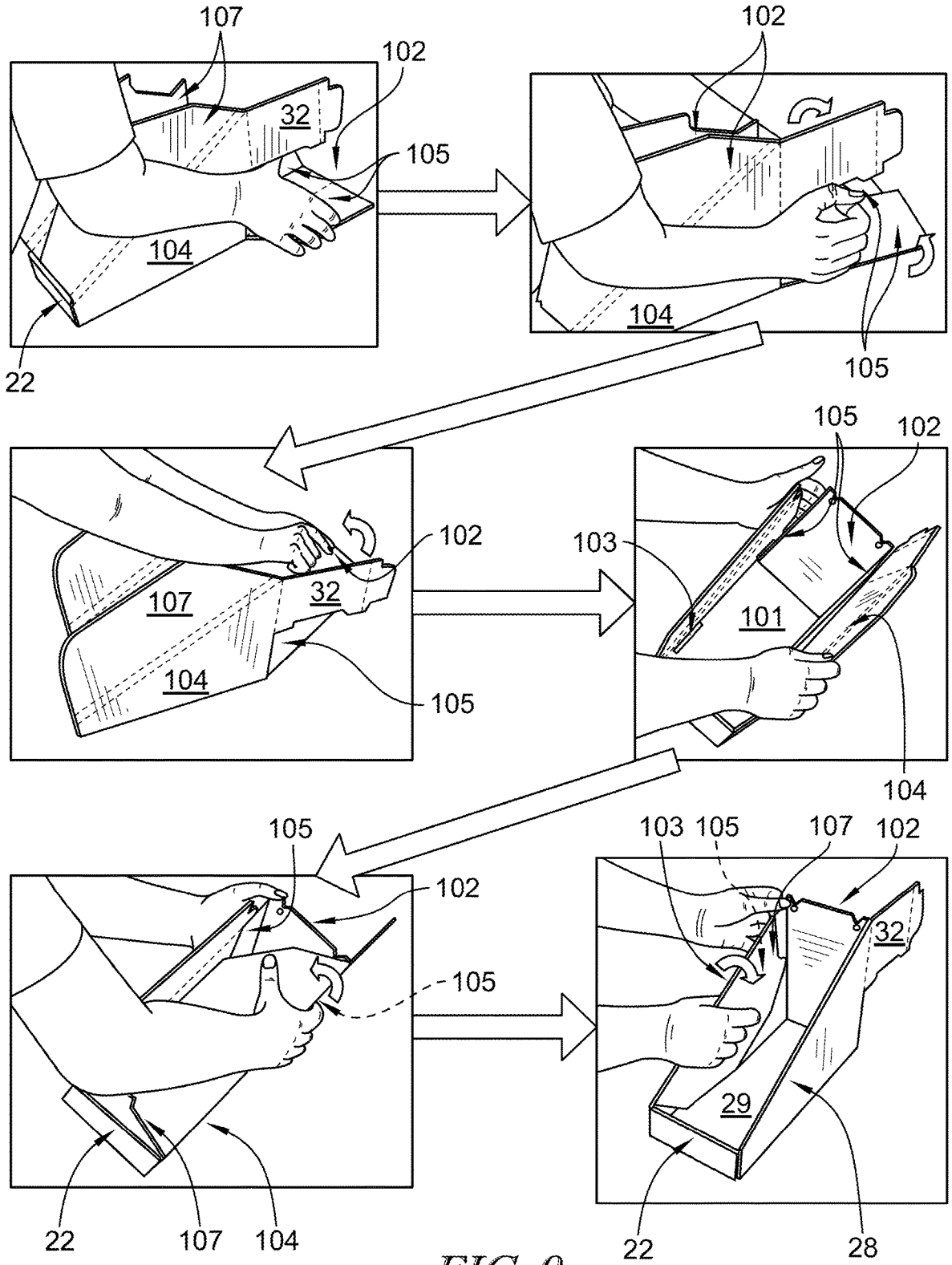

Flaps 105 are folded relative to back panel 102, and panel 102 is folded relative to base panel 101 to position flaps 105 between panels 103, 104 and extending toward front wall 22 as shown in FIG. 9. Flaps 107 are folded relative to side panels 103, 104 over flaps 105 to trap flaps 105 and hold panel 102 in place. Flaps 105, 107 and panels 103, 104 form left and right side walls 26, 28 of tray 14. Tabs 141 of flaps 107 engage with slots 143 of panel 101 to hold flaps 107 in place.

Figure 10:
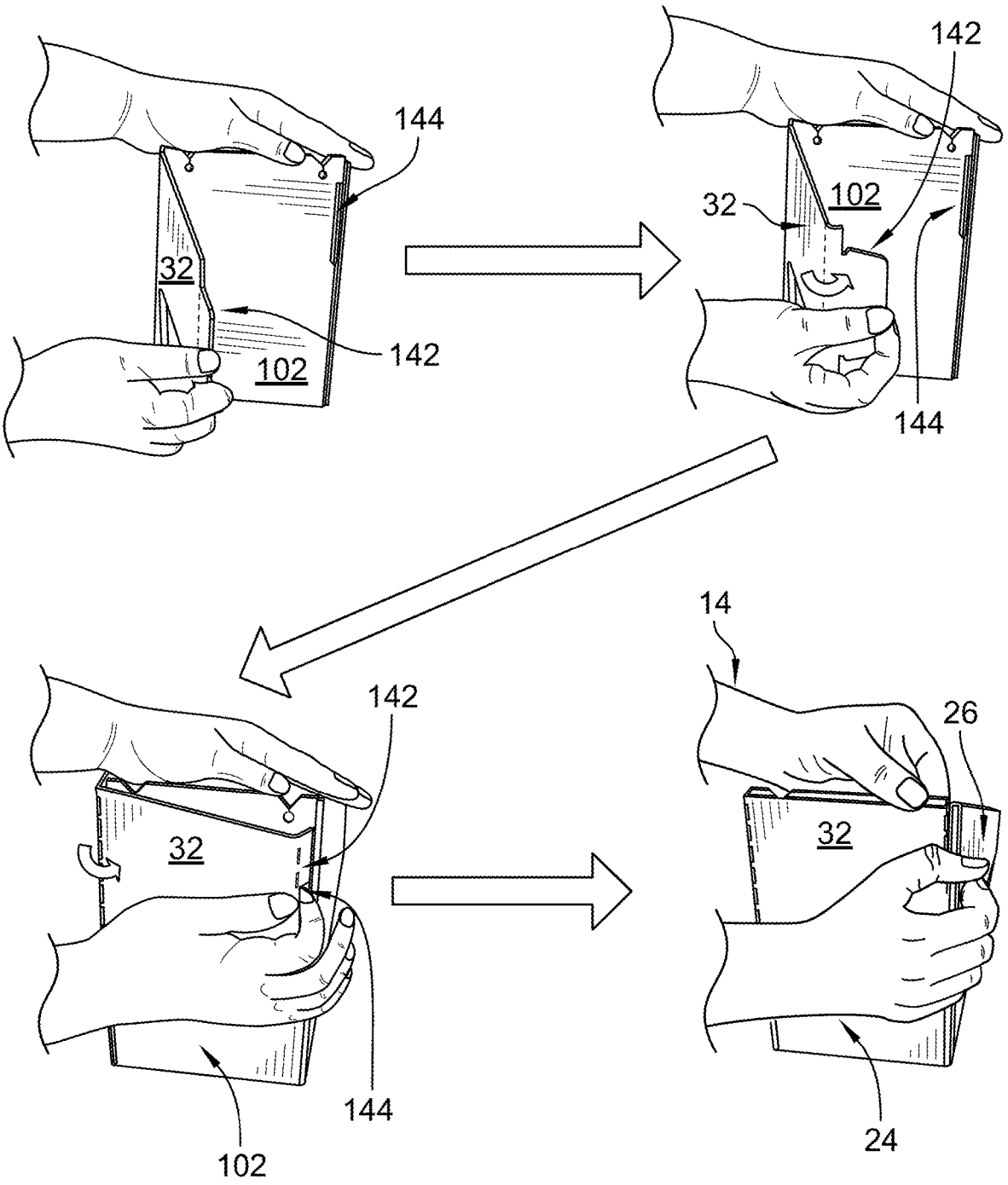
Figure 11:
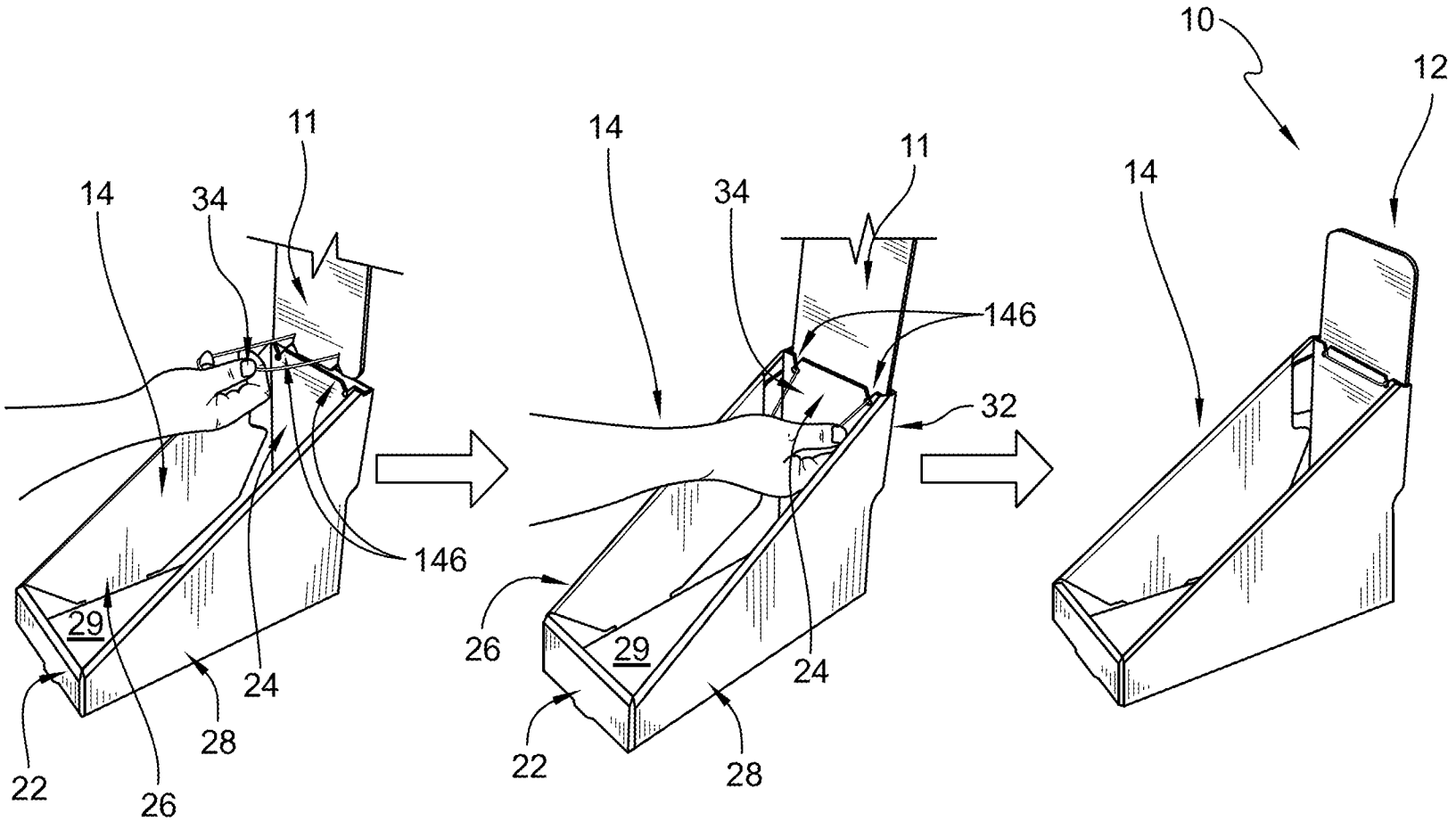
FIG. 11 is a series of views showing a process in accordance with the present disclosure for attaching the header board to the tray.
Figure 12:
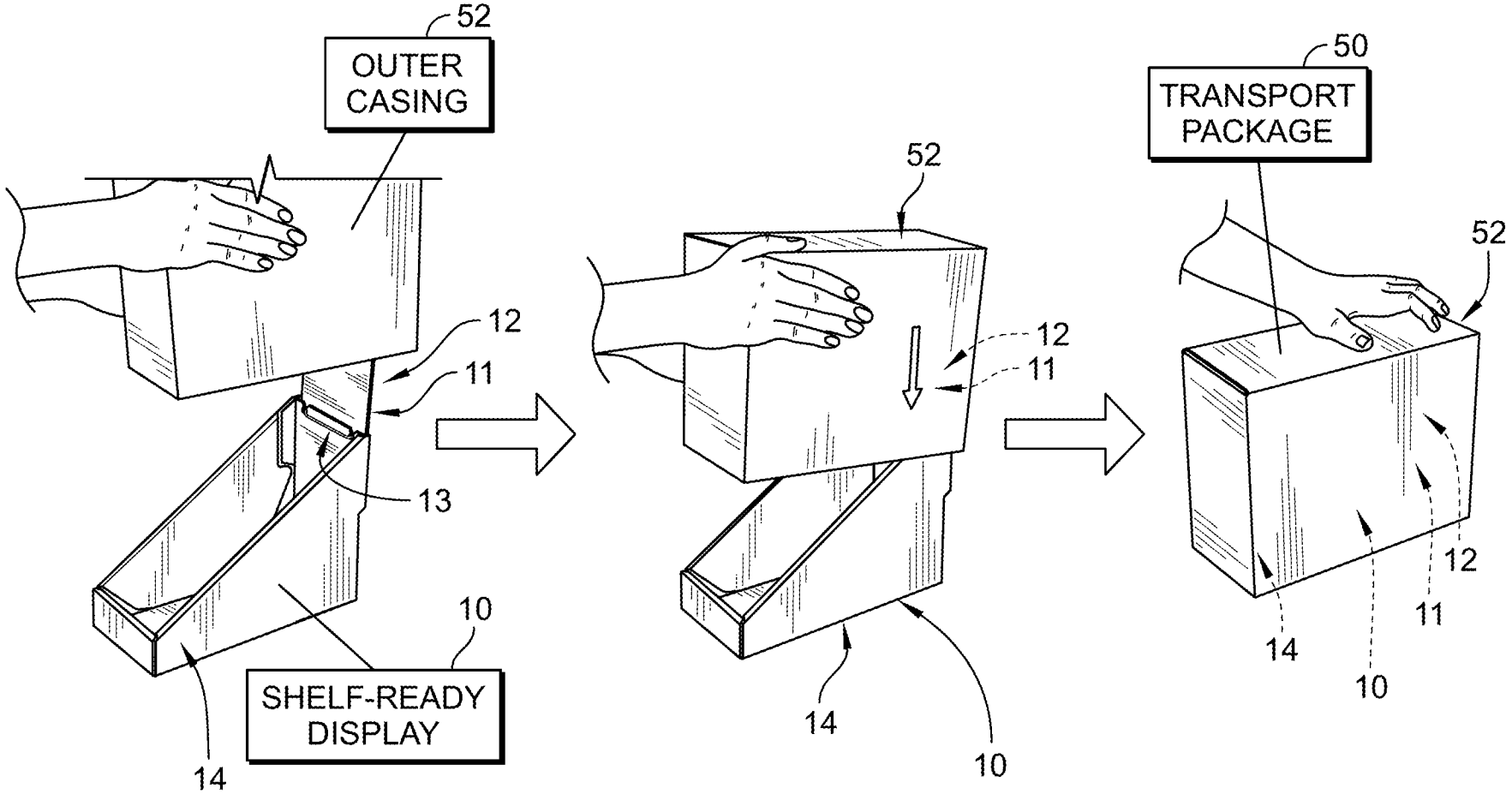
FIG. 12 is a series of views showing a process in accordance with the present disclosure for forming a transport package by positioning an outer casing relative to the product display.

Brace 32 is folded to extend along back panel 102, and lock tab 142 is inserted into slot 144, to form back wall 24 and complete formation of tray 14 as shown in FIG. 10. Header board 11 is positioned relative to back wall 24 and board mover 34 is inserted into notches 146 to form display header 12 as shown in FIG. 11. In some embodiments, display header 12 is attached to tray 14 before product is stored in tray 14 and shipped to a retail location such that product display 10 is "shelf-ready" where no labor is required to attach display header 12 to tray 14 at the retail location. Display header 12 is moved to the shipping position and an outer casing 42 is positioned to surround product display 10 to form a transport package 40 and retain the product on tray 14 and hold display header 12 in the shipping position during transit of product display 10 to a retail location as suggested in FIG. 12. A user of product display 10 removes outer casing 42 to expose the product stored in tray 14 and header mount 13 moves header board 11 to the display position for showing product indicia 16 to customers at the retail location.

In illustrative embodiments, a self-deploying retail ready header 12 is attached to a tray 14 of a counter-top or shelf display 10. A header brace 32 creates a pocket for a header board 11 to fit into. Brace 32 and tray 14 are formed as one piece, but can be formed separately and attached to one another depending on a width and height of the tray. The tray, brace, and header board can be formed in a single die cut blank to reduce material consumption.

In illustrative embodiments, display header 12 automatically pops-up when used. Display header 12 is adaptable for use with a variety of trays in a retail environment. In illustrative embodiments, brace 32 is used to hold a graphic header 11 in place as header 11 is in a shipping (or down) position during shipment or in a display (or up) position when deployed. Brace 32 is used as a guide to help move header 11 up and down and protect header 11 in the down position during shipment.

In illustrative embodiments, an elastic cord 34 with barbs attached to the ends are used to pull up graphic header 11 when a cover, shroud, or outer casing is removed from product display 10 in a retail location. More or less cords can be used depending on the size and weight of header 11, and 3D effects which may cause friction between header 11 and back wall 24. A length of elastic cord 34 can be adjusted based on a height of header 11 used in product display 10.

In illustrative embodiments, header 11 is a planar board of corrugated or other material. Graphics or other indicia 16 are applied to header 11 by direct print, litho label (full or spot mount), litho lamination, screen printing, or digital printing for example. Header 11 can also include 3D elements which may move relative to the header board as the header moves upward or downward.

In illustrative embodiments, display header 12 includes elastic band 34, brace 32, and a graphic header board 11 which in combination attach to a retail display vehicle or tray 14. Once the display header is attached to a display vehicle, the graphic header board is moved into the down position for shipment. A shrink film or corrugated shroud are placed around the tray and display header to protect it for shipment. Once the display vehicle arrives to its intended destination (e.g., a retail location), a user removes the protective cover and the header board will automatically be lifted upward via the elastic band into the up position therefore showing the graphics on the front and/or back.

In illustrative embodiments, no labor is involved by a user in the retail setting. This solves a problem in that current graphic headers ship loose or separate from the display vehicle. Many times those loose headers are placed on the top or may be attached via plastic rivets or clips. In either case, a user must find the header (if loose), read the set up instruction sheet, and attach the header to the display vehicle. In many situations, the product display does not include a header, or the header is left unattached. Display header 12 of the present disclosure automatically moves the graphic element (e.g., header board 11) up into position meeting retail compliance requirements and saving labor.

The invention claimed is:

1. A blank for forming a product display having tray and a display header coupled to the tray, the blank comprising a base panel, a back panel coupled to the base panel and foldable relative to the base panel, a first set of flaps coupled to opposing sides of the back panel and foldable relative to the back panel toward one another, a lock flap coupled to an opposing end of the base panel from the back panel and foldable relative to the base panel toward the back panel, side panels coupled to opposing sides of the base panel and extending from the lock flap to the back panel, the side panels foldable relative to the base panel toward one another, a second set of flaps, one flap of the second set of flaps coupled along a distal end of one of the side panels opposite the base panel and the other flap of the second set of flaps coupled along a distal end of the other of the side panels opposite the base panel, a third set of flaps coupled to the side panels adjacent to the lock flap and foldable relative to the side panels, a brace coupled to one of the side panels and foldable relative to the side panels, and a header board positioned adjacent to the other side panel opposite of the brace, wherein the lock flap and the third set of flaps together define a front wall of the tray, the side panels together with the first and second sets of flaps define side walls of the tray, the back panel and the brace together define a back wall of the tray, and the base panel defines a floor of the tray when the blank is folded, wherein the brace is integrally formed with the tray at a first end, and wherein a tab extends from an opposite second end of the brace to engage with a slot of formed in the back panel when the blank is folded.

2. The blank of claim 1, wherein tabs extend from the second set of flaps and engage with slots formed in the base panel when the blank is folded.

3. The blank of claim 1, wherein the lock flap includes a proximal strip coupled to the base panel and a distal strip coupled to an opposing end of the proximal strip from the base panel, wherein the proximal strip is foldable relative to the base panel and the distal strip is foldable relative to the proximal strip, wherein the third set of tabs extend toward one another and are positioned between the proximal strip and the distal strip when the blank is folded, and wherein a tab extends from the distal strip to engage with a slot formed in the base panel when the blank is folded.

* * * * *